US006349660B2

(12) United States Patent
Chaix

(10) Patent No.: US 6,349,660 B2
(45) Date of Patent: Feb. 26, 2002

(54) DEVICE FOR STABILIZING A SHIP, ESPECIALLY WHEN ROLLING

(75) Inventor: Edmond Chaix, Pierrevert (FR)

(73) Assignee: Societe Technique pour l'Energie Atomique Technicatome, Gif sur Yvette (FR)

( * ) Notice: Subject to any disclaimer, the term of this patent is extended or adjusted under 35 U.S.C. 154(b) by 0 days.

(21) Appl. No.: 09/739,196

(22) Filed: Dec. 18, 2000

(51) Int. Cl.[7] ..... B63B 39/02
(52) U.S. Cl. ..... 114/124
(58) Field of Search ..... 114/121, 122, 114/124, 123, 125

(56) References Cited

U.S. PATENT DOCUMENTS

| | | | | |
|---|---|---|---|---|
| 1,853,069 A | | 4/1932 | Minorsky | |
| 3,426,718 A | | 2/1969 | Slager et al. | |
| 3,934,534 A | * | 1/1976 | Larsh | 114/122 |
| 5,433,162 A | * | 7/1995 | Shigematsu et al. | 114/124 |
| 5,713,163 A | * | 2/1998 | Mutaguchi et al. | 52/167.1 |
| 6,019,056 A | * | 2/2000 | Maeda et al. | 114/122 |

FOREIGN PATENT DOCUMENTS

| | | |
|---|---|---|
| DE | 324 970 | 9/1920 |
| DE | 349 886 | 3/1922 |
| FR | 2 322 778 | 4/1977 |
| FR | 2 687 978 | 9/1993 |

* cited by examiner

*Primary Examiner*—S. Joseph Morano
*Assistant Examiner*—Ajay Vasudeva
(74) *Attorney, Agent, or Firm*—Pearne & Gordon LLP

(57) ABSTRACT

The device makes it possible to stabilize high tonnage ship, when several of them are used.

Figure 1:
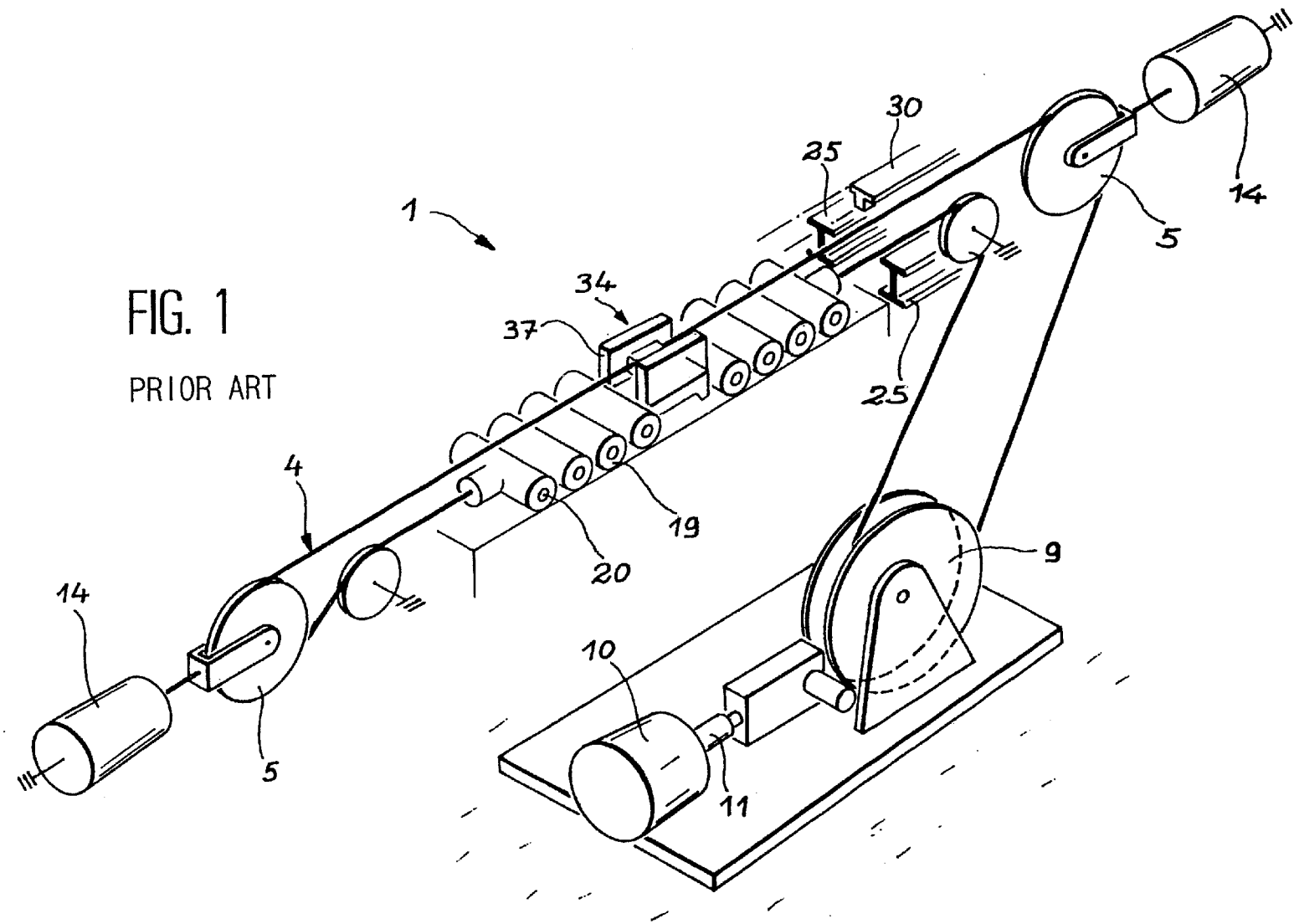
FIG. 1 PRIOR ART

Mainly, it comprises a train of mobile lead masses (12), completed at each end by a pair of jaws (16) pressing against the lateral rails of a housing (3). A single cable (2) serves to pull the train and to control the release of the jaws (16). The control means for displacement and for cable tension are placed on one side of the ship. The winch (20) of one device can be coupled to the winch of an adjacent device, thus allowing compensation should a device fail.

Application refers to the stabilization of high tonnage ships, such as aircraft carriers.

12 Claims, 5 Drawing Sheets

FIG. 7
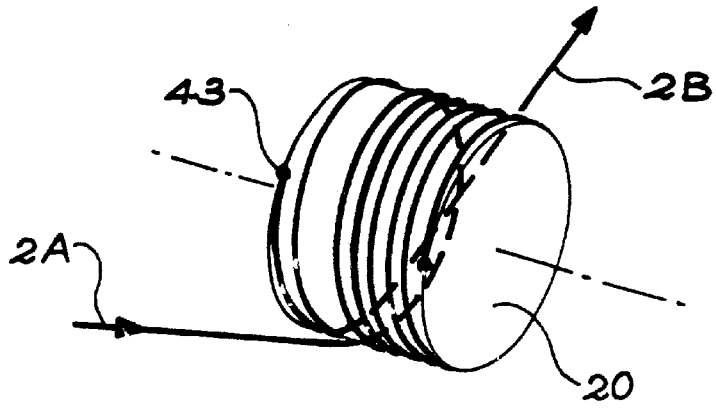
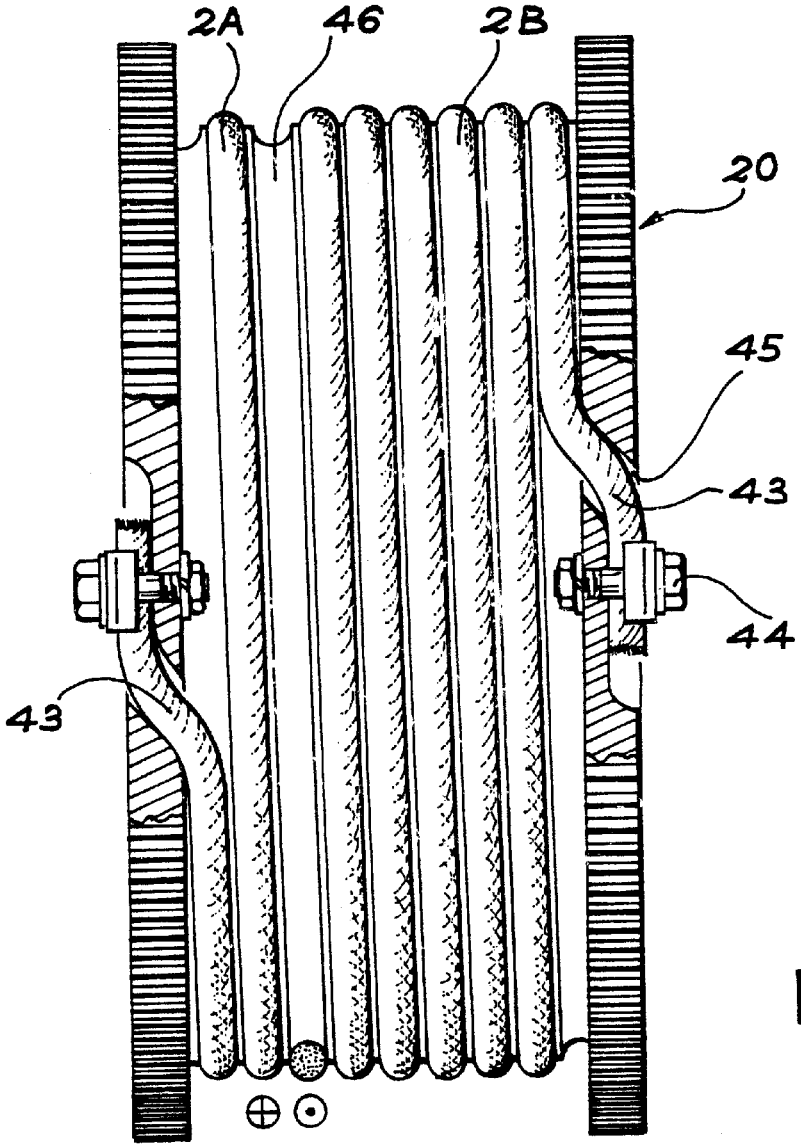
FIG. 8

DEVICE FOR STABILIZING A SHIP, ESPECIALLY WHEN ROLLING

FIELD OF THE INVENTION

The present invention relates to stabilizing high tonnage ships, such as aircraft carriers and, in particular, stabilization when rolling, that is when listing.

PREVIOUS STATE OF THE ART AND THE PROBLEM TO BE SOLVED

Through the French patent application 2 687 978, filed by the same applicant, a device for stabilizing a ship is known, especially when rolling, using a track on which a train of solid ballast circulates. In fact, referring to FIG. 1 of this document, the stabilizing elements are constituted of two sets or series of rollers 19, rolling on a track constituted, for example, of two lateral rails 25 and 26. A cable 4, driven by a motor 10, through the intermediary of a drive drum 9, makes it possible to displace the rollers 19 from one side to the other of the ship. A blocking system 34, using two jaws 37, is placed between the two sets of rollers 19, and controlled by cable 4. The ensemble is immobilized by closing the jaws 34 against a central positioning rail 30, placed longitudinally above the device. When the cable is not taut, the jaws 34 clamp the central positioning rail 30. In this device, two lateral electric jacks 14 are also used to tighten the cable at its two ends, by the intermediary of a sheave 5, fixed to the pin of the jack. Several such devices can be mounted in parallel in the holds of the same ship, as part of its deck structure.

It is easy to understand that, when the cable is taut, the two clamping jaws 37 separate from each other to free the device relative to the central positioning rail 30. The set of rollers 19 can then be displaced by traction of cable 4, from one side or the other. Suppression of tension, voluntary or provoked by rupture of a strand of the cable 4, automatically blocks the clamping jaws 37 against the central positioning rail 30, in the closest position.

The blocking system used here, in the central part of the assembly, that is in the middle of the two sets of rollers, requires an extremely secure link between the different mobile masses constituted by the rollers. In the same way, the presence of the central blocking rail makes it necessary to envisage rollers 19 of restricted diameter, at least in their central part, to leave a space for the positioning rail 30 to pass through. Because of this, the mass of the assembly is reduced considerably, as well as the efficiency of the system.

In addition, the presence of two electric jacks 14 and their respective mobile sheaves 5 on each side of the system, penalises the system because of their overall dimensions.

The aim of the invention is therefore to remedy these inconveniences, by proposing a different stabilizing device for a ship.

SUMMARY OF THE INVENTION

To this end, the main aim of the invention is a stabilizing device for a ship, particularly when rolling, comprising:

- a train with a mobile mass rolling on a track;
- means for immobilizing the train;
- a cable for traction of the train and for controlling the means of immobilization;
- a drive means for actuating the cable, and;
- means for adjusting the tension of the cable in order to control the means of immobilization, comprising two mobile sheaves to adjust the tension of the cable.

According to the main characteristic of the invention, the means of adjustment also possess a fixed sheave placed on one side of the device, the two mobile sheaves being controlled by a single jack and placed on the other side of the device, opposite the fixed sheave, with the drive means and the jack.

In the preferred embodiment of the means of adjustment, the two mobile sheaves are linked to each other in an elastic fashion, the cable passing around these two mobile sheaves, the drive means being constituted of a winch placed between these two mobile sheaves and around whose drum the cable is rolled.

Advantageously the two strands of cable are fixed in inverse fashion on the winch, around which they roll and unroll, thus alternately and simultaneously.

Preferably, the jack is a hydraulic jack.

In the main embodiment of the invention, it is linked in an elastic fashion to one of the two mobile sheaves.

Advantageously it can be controlled by a solenoid valve.

In the case where means for guiding the train laterally are envisaged, that is with two lateral rails, the means of immobilization essentially comprise a pair of jaws, each pair being controlled by one end of the cable, the jaws of each pair being kept apart from each other by elastic means to come to bear on the lateral rails, their opening being controlled by tension of the cable on these two ends.

In the latter case and when the lateral rails have a standardized I section (IPN), defining two concave parts with three internal surfaces, it is envisaged that the two jaws of each pair of jaws should have three friction surfaces bearing on the three internal surfaces of this winch.

In the case where several stabilizing devices are used on the same ship, it is preferable to envisage, on each winch, means for temporary coupling of the winch with an adjacent device so that, in the event of a breakdown, one of the winches can pull the other.

Advantageously, with the aim of raising the efficiency of the device and, in particular, to optimize the compensation torque provided by the train of mobile mass, the latter should by constituted of lead blocks quasi-parallelepiped in shape, mounted on small wheels rolling on the track.

When the train has to be enclosed in a metallic housing, as imposed by certain requirements concerning high tonnage ships, the track on which these mobile masses roll is constituted by the lower interior surface of the housing, which is installed transversally relative to the axis of the ship.

LIST OF FIGURES

Figure 2:
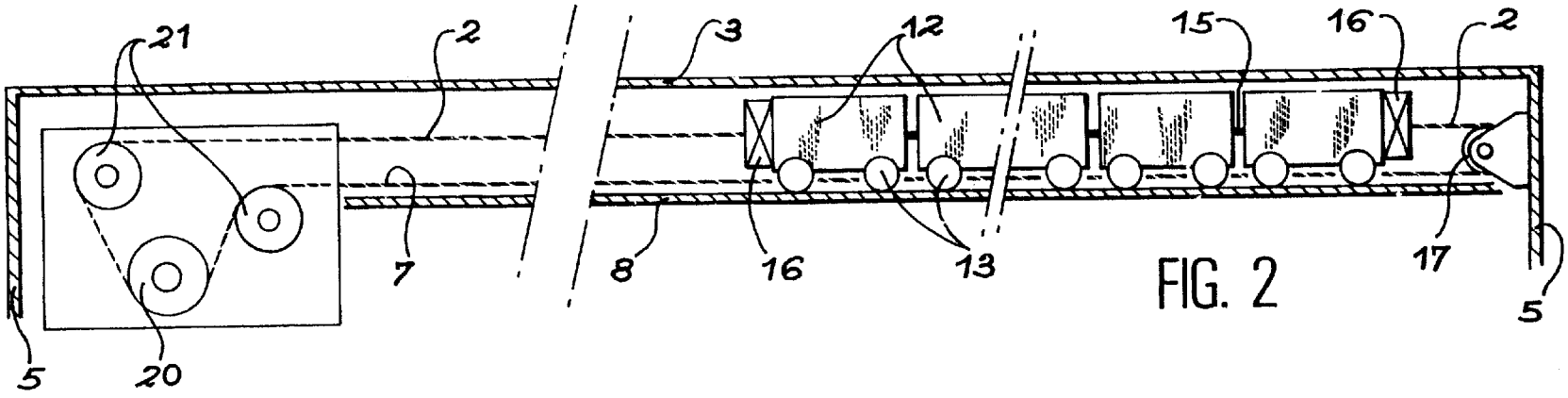
Figure 3:
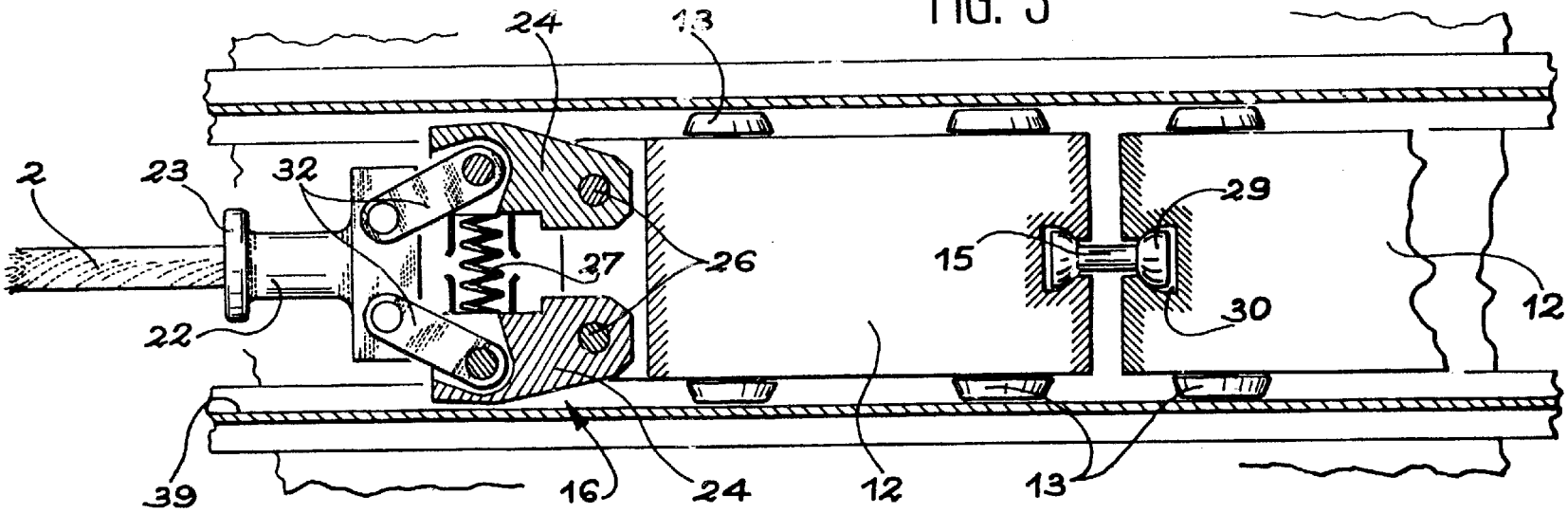

The invention and its different technical characteristics will be better understood by reading the text below, which is accompanied by several figures representing, respectively:

FIG. 1, a bird's eye view of a stabilizing device according to prior art;

FIG. 2, a global view, in cross-section, of the stabilizing device according to the invention;

FIG. 3, a top view, in cross-section, of a pair of jaws used in the means for immobilization of the train of the stabilizing device according to the invention.

Figure 4:
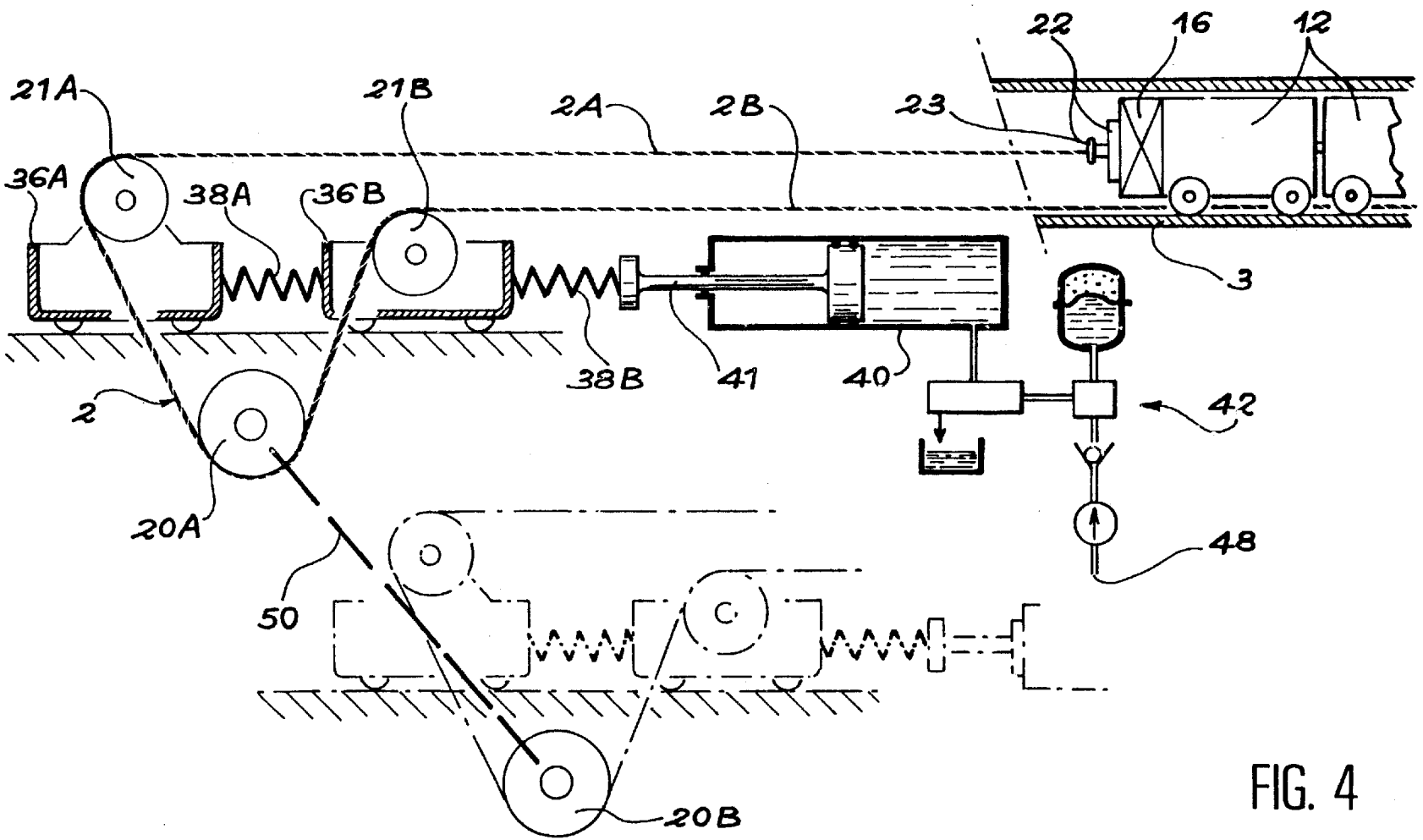
Figure 6:
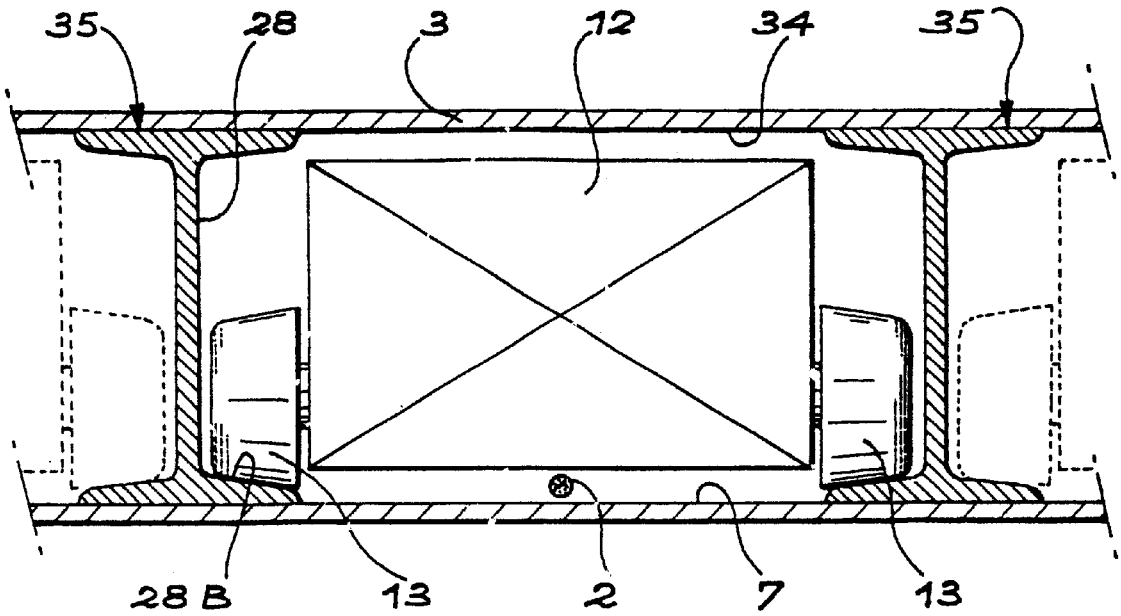
Figure 5:
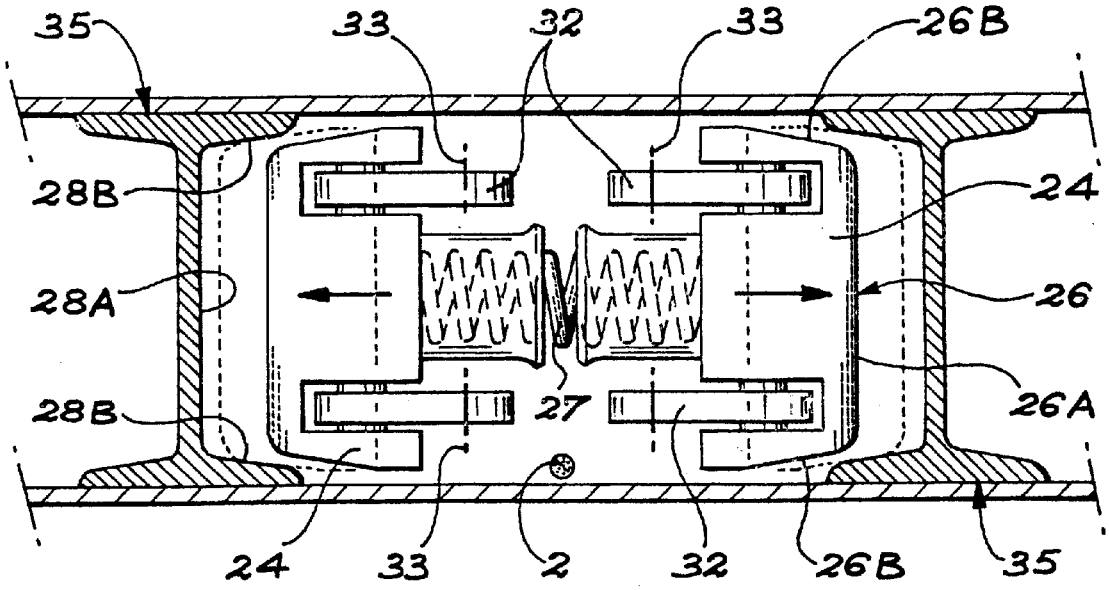

FIG. 4, a detailed view of the drive means and means for adjustment of the tension of the cable in the device according to the invention;

FIG. 5, a side view of the jaws shown in FIG. 4;

FIG. 6, a cross-section, seen from the side, of one of the mobile masses of the train of a stabilizing device according to the invention;

FIG. 7, a diagram of the rolling of the cable on the winch of a stabilizing device according to the invention;

FIG. 8, the winch of the stabilizing device according to the invention.

DETAILED DESCRIPTION OF AN EMBODIMENT OF THE INVENTION

With reference to FIG. 2, the stabilizing system according to the invention is installed transversally in the ship, which is symbolized by its lateral walls 5. A metallic housing 3 is thus set transversally on a deck of the ship or as a ceiling under a deck. The interior surface 7 of the lower wall 8 of the housing 3 serves as the track for the train of mobile mass, which is placed inside the housing. This train comprises several wagons each constituted of a lead mass 12 mounted on small wheels 13 which roll on the interior surface 7 of the lower wall 8 of the housing 3. It is understood that the wagons constituted in this way are connected to each other by a coupling hook 15 placed between each of the lead masses 12. At each end of the train there is a pair of jaws 16 intended to immobilize the train by opening or closing and by bearing on the lateral walls of the housing 3. These two pairs of jaws 16 thus constitute the means for immobilizing the train in the housing 3 at a given point. The fact that two pairs of jaws 16 are used, one at each end of the train, balances these means of immobilization and provides them with an additional character constituting an extra security, in the case where one of the two pairs of jaws 16 should fail.

The train is pulled by a cable 2, which also controls the operation of the two pairs of jaws 16. It is rolled up, in the right part, on a fixed sheave 17 secured to the hull of the ship, for example to the lateral wall 5. On its left side, the cable 2 passes into a control assembly, comprising a winch 20 placed between two mobile sheaves 21. The winch 20 makes it possible to control the movements of the train by pulling the cable 2 in one direction or the other. The two mobile sheaves 21 control the tension of the cable 2, thus making it possible to operate the two pairs of jaws 16. The details of this control assembly are explained later in FIG. 4.

FIG. 3 makes it possible to see how the cable 2, pair of jaws 16 and the train are fixed relative to each other. The end of the cable 2 is fixed directly onto a jaw control part 22 by means of a shoulder 23 constituting a connection to a gripping tool, in the event that the cable 2 should break. Two jaws 24 are mounted so as to pivot, each around a vertical axis 26, fixed relative to the lead weight 12 at the end of the train. A powerful spring 27 keeps the two jaws 24 permanently apart so that each of them presses against the lateral internal wall 39 of the housing. The lead masses 12 are coupled to each other by a coupling hook 15, which can advantageously be constituted of two slightly swivel heads 29, each inserted into a coupling cavity 30 in the lead mass 12.

On the other hand, when the two mobile sheaves 21 of FIG. 2 act simultaneously to vary the tension of the cable, that is to say act by traction on the two ends of the two strands of the cable 2, a traction effort is then exercised on each of the pairs of jaws 16. In fact, if the cable pulls in a balanced way on the two ends of the train, the latter will remain immobile, while the jaw control parts 22 will apply a traction on the two jaws of a same pair 24 through the intermediary of two connecting rods 32. Thus, the latter will be brought closer together by compression of the spring 27 and the winch can then fulfil its function of control of the movement of the train by pulling one of the two cable strands 2.

When the winch 20 pulls the cable 2, which exerts a traction on one train side, the latter is pulled to move by rolling inside the housing 3. Thus, the ensemble of lead masses 12 is moved from one place to another, to obtain the transversal stabilizing effect of the ship.

In reference to FIG. 5, one understands better how the jaws 24 can act on the lateral interior surface 28 of the lateral walls of the housing, in the case where the latter are each advantageously constituted of a section in I shape, of the IPN type and whose height corresponds to the internal height of the housing in which the train is set. IPN 35 sections each possess two concave parts one of which corresponds to the interior lateral surface 28. The latter is comprised of three parts, one vertical part 28A and two inclined parts 28B at the top and at the bottom of the I. Correspondingly, each jaw 24 has three surfaces, one vertical surface 26A and two inclined surfaces 26B placed on either side of the vertical surface 26A and forming an external surface corresponding to the internal concave surface 28 of the IPN 35 section. Thus, each jaw 24 has a maximum effect since a maximum external surface 26 acts on the lateral internal surface 28 of the housing.

In FIG. 5, four connecting rods 32 are also shown, two for each jaw 24. Their rotation axis relative to the control part 22 of FIG. 3, is symbolized by a straight line of dots and dashes 33.

In reference, together with FIGS. 3 and 6, it can be noted that the shape of each lead mass 12 is a parallelepiped. Above all, it is to be noted that the dimensions of each lead mass 12 correspond to the dimensions of the interior volume of the housing 3, defined principally by the lower interior surfaces 7 and the upper interior surfaces 34 and by the interior surfaces 28 of the IPN 35 sections. As a result, a maximum of the internal volume of the housing 3 is occupied by the lead masses 12, which constitutes a gain in weight compared to the system described in the patent application FR-2 687 978 and mentioned in the paragraph describing prior art. In fact, the presence of a central rail, reference 30, reduces significantly the space available for the mobile masses. The fixation of such a rail 30, taking into account the special specifications of the steel of which it is made, poses technological problems, in particular welding capacity, and its reduced size, because of tightening efforts, produces significant strain levels.

In FIG. 6, it can be noted that the wheels 13 of each mobile mass 12 rest on the lower inclined wall 28A of the concave interior surface 28 of the IPN 35 sections, which contributes to centring naturally the mobile masses in the housing. Finally, it is to be noted that the cable 2 is lodged below the lead masses 12 and above the lower interior surface 7 of the housing.

FIG. 4 represents in detail the control assembly of cable 2. The end of the train, and more precisely, the last lead mass 12 can be seen, equipped with a pair of jaws 16 and its support 22 as well as the shoulder 23, to which the first cable strand 2A is fixed. The latter passes around a first sheave 21A, mounted mobile in horizontal translation on a first translation cart 36A, mounted rolling on a floor of the ship.

The second cable strand 2B passes underneath the train and ends up on the other side. It passes around a second mobile sheave 21B, mounted on a second translation chariot 36B, also mounted to roll on a floor of the ship. The two translation carts 36A and 36B are linked together in an elastic fashion by means of a first spring 38A. However, one of them, in this case the second cart 38B, is itself linked elastically to the mobile rod 41 of a fixed hydraulic jack 40.

On their side, the two strands 2A and 2B are rolled up on the winch drum 20A, between its passage over the first mobile sheave 21A and its passage over the second mobile sheave 21B. Whatever the position of the winch 20A relative to the two mobile sheaves 21A and 21B, it must be set in such a way that the cable 2 passes around these two mobile sheaves 21A and 21B, over more than a quarter of a turn, in opposition to the pull due to the fixation of the two strands 2A and 2B of the cable 2 to the train of lead masses.

It is simple to understand that, in the case where the hydraulic jack 40 pushes its mobile rod 41 in the direction of the two translation carts 36A and 36B, the two cable strands 2A and 2B will be pulled under tension relative to their fixation on the mobile train. Thus, the jaws of the two pairs of jaws 16 will be pulled under tension and will come closer together, freeing in translation the mobile train of lead masses 12. The winch 20A can then fulfil its control function for translation of the train, which is no longer immobilized in the housing 3.

It is also to be noted that the hydraulic jack is controlled by an opening valve through lack of current, such as a three-way control valve 42. In other terms, the release of the two strands 2A and 2B of the cable is provoked by the opening of the valve from lack of current, which raises the overall reliability of the system, compared to a tensioner using an electric jack and thus requiring an electricity supply for the release of the two strands 2A and 2B of the cable. In the present case, the tension of the cable 2, that is to say the freeing of the train, is carried out by activating the hydraulic jack 40 through the action of the valve 42.

The use of a hydraulic jack 40 also makes it possible to reduce the mass of the means of control compared with that described in the device of the patent application 2 687 978, described above. The bearing force generated by the hydraulic jack 40 is independent of the position of the mobile rod 41 of the latter and only depends on the pressure used and the cross-section of the jack piston, which is constant. A manometer 48 makes it possible to monitor the tension forces of the two cable strands directly.

Thus it is to be noted that, in the present case, the assembly of control organs for cable 2, both in displacement and in tension, is situated on a single side of the train, that is to say on one side of the ship. The only element belonging to the device on the other side is the fixed sheave, reference 17 in FIG. 2.

In FIG. 4, marked in dots and dashes, a second control assembly is shown, identical to that in solid lines. This concerns a control assembly of a stabilizing device identical to that described above and placed next to it. In fact, so as to be effective on a high tonnage ship, several examples of the stabilizing device according to the invention must be used. In fact, advantageously, four or five stabilizing devices according to the invention should be set in the fore and four or five stabilizing devices in the aft of the ship. It is to be noted that such a stabilizing arrangement can thus displace ten lead masses 12, each weighing about two tons. By using ten stabilizing devices according to the invention, one thus has at one's disposal two hundred tons for stabilization on a single ship.

In addition, if one of these ten stabilizing devices fails, its winch 20A or 20B can be coupled to the winch 20B or 20A of the adjacent device by temporary coupling means 50, symbolized by a broken line, linking the two winches 20A and 20B. Thus, it is possible to drive the winch of a failed stabilizing device by coupling it with the winch of the adjacent device to activate it, even at reduced speed. This is particularly useful if the mobile masses of the train of the stabilizing device which has failed are on one side. In fact, the neighbouring device can then proceed with displacing the train through temporary coupling of one winch with the other and can position the broken-down mobile train in the middle of the ship.

It is to be noted that, in the case of rupture of one of the strands 2A or 2B of the cable, the corresponding pair of jaws can no longer be activated and thus remain blocked by separation of the jaws, thus blocking the train in its position. Evidently, this constitutes a security measure.

In FIG. 7, each of the two strands 2A and 2B of the cable roll around one part of the peripheral surface of the winch 20. In addition, each end 43 of each strand 2A and 2B is fixed on the winch, for example by means of a bolt 44 and a baffle 45 gripping the end 43 of a cable strand. In other terms, the surface of the cylindrical periphery of the winch 20 is reserved for rolling up each of the two strands 2A and 2B of the cable.

FIG. 8 shows the advantageous presence of two grooves 46 each intended to receive a strand 2A or 2B of the cable. In addition, if each of the ends 43 of the two strands 2A and 2B is fixed to one end of the cylinder constituting the winch 20, one can envisage that the groove 46 is common to the two strands 2A and 2B. In fact, during a rotation of the winch 20, one of the two strands 2A rolls up while the other 2B unrolls, or the reverse, the length of the groove 46 used being almost constant. Thus, the unrolling of a strand 2A leaves place for the rolling up of the other strand 2B of the cable.

Advantages of the Device Acoording to the Invention

The parallelepiped shape of the mobile lead masses 12 makes it possible to optimize the volume of the tunnel constituted by the housing 3. Thus, one gains space and therefore weight, by using such mobile masses. The efficiency of the device is thus raised.

The use of a pair of jaws 16 at each end of the train makes it possible not to call on the coupling hooks of the train during its many periods of immobilization. This constitutes a considerable advantage, especially when the ship is in an inclined position. One thus takes precautions against an accidental rupture of one of the coupling hooks.

The maintenance and control of the pairs of jaws 16 is relatively simple. It is also much simpler than the maintenance of central jaws, referenced 34, of the prior art device. In fact, the latter is in the middle of the train, which is enclosed in the housing; it is thus practically inaccessible.

In the event of rupture of one of the two cable strands, recuperation of the train is relatively easy, thanks to the shoulder 23, between each strand 2A and 2B and the jaw support 22.

The presence of two braking systems, as constituted by each pair of jaws 22, constitutes a security, particularly in the case of rupture of the two strands of the cable 2, during a manoeuvre of the mobile train.

The juxtaposition of two stabilizing devices, according to the invention, whose winches 20A and 20B respectively are temporarily coupled together, makes it possible to rescue one of the devices which may have failed and been immobilized in a position which could endanger the balance of the ship.

The constitution of mobile lead masses 12, equipped with four small wheels 13, allows them to move on the flanges of standard sections 35, constituting the lateral parts of the housing.

The use of coupling hooks 15 of the swivel type or similar allows a certain freedom of movement between the lead masses 12, particularly at an angle. The use of a system with two mobile sheaves, constituting a double stage tensioner, provided with a single hydraulic jack 40, makes it possible to tighten the two cable strands 2A and 2B without servo-control of position and to release them without any energy supply.

The respective rolling up of the two strands 2A and 2B of the cable on the winch 20, as described above, makes it possible to avoid rolling up by reeling.

What is claimed is:

1. Stabilizing device for ships, comprising:

a train of mobile masses rolling on a track;

means of immobilizing the train;

a cable (2) for traction of the train and for controlling the means of immobilization;

a drive means for actuating the cable (2); and a control means for adjusting the tension of the cable (2) in order to control the means of immobilization, and comprising two mobile sheaves to adjust the tension of the cable (2), characterized in that the control means comprise a fixed sheave (17) disposed on one side of the device, and two mobile sheaves (21A, 21B) being controlled by a single jack (40), wherein both mobile sheaves are placed on another side of the device opposite to the fixed sheave (17), together with the drive means and the jack (40).

2. Device according to claim 1, characterized in that the mobile sheaves (21A and 21B) are linked together, in an elastic fashion, the cable (2) passing around the two mobile sheaves (21A and 21B).

3. Device according to claim 2, characterized in that the first mobile sheave (21B) is linked in an elastic fashion to the jack (40).

4. Device according to claim 1, characterized in that the drive means are constituted of a winch (20, 20A, 20B), placed between the two mobile sheaves (21A, 21B).

5. Device according to claim 4, characterized in that two strands (2A, 2B) of the cable (2) are fixed on the winch (20, 20A, 20B) in reverse fashion, and around which they roll and unroll, and simultaneously.

6. Device according to claim 4, characterized in that each winch (20A, 20B) is adaptable to have temporary coupling means (48) with the winch (20B, 20A) of an adjacent device, so that any one winch is adaptable to drive the other, should either of them fail.

7. Device according to claim 1, characterized in that the jack (40) is a hydraulic jack.

8. Device according to claim 7, characterized in that the hydraulic jack (40) is controlled by a solenoid valve lacking current (42).

9. Device according to claim 1, in which the track means of the train are two lateral sections (35), characterized in that the means of immobilization comprise a pair of jaws (24) at each end of the train, the jaws (24) being biased apart against the interior surface of the lateral sections and linked to one end of the cable (2) whose tension makes the two jaws (24) of a pair of jaws (16) close together.

10. Device according to claim 9, characterized in that the two lateral sections being standardized I sections with at least one internal concave part constituted of an internal vertical surface (28A) and two internal inclined surfaces (28B), and further characterized in that the jaws (24) possess three friction surfaces, one vertical friction surface (26A) and two inclined friction surfaces (26B), respectively on the three-internal surfaces (28A, 28B) of the corresponding lateral section (35).

11. Device according to claim 1, characterized in that the mobile masses are constituted of lead masses (12) of a quasi-parallelepiped shape and mounted on small wheels (13) rolling on the track.

12. Device according to claim 1, characterized in that the track is constituted by a lower interior surface (7) of a metallic housing (3) and adaptable to be installed transversely relative to a longitudinal axis of the ship.

* * * * *

UNITED STATES PATENT AND TRADEMARK OFFICE

CERTIFICATE OF CORRECTION

PATENT NO. : 6,349,660 B2
DATED : February 26, 2002
INVENTOR(S) : Chaix

It is certified that error appears in the above-identified patent and that said Letters Patent is hereby corrected as shown below:

Title page,
The Foreign Application Priority Data was omitted. Please insert it as follows:

Foreign Application Priority Data
-- Dec. 20, 1999 (FR) ……..99 16066 --;

Item [57], ABSTRACT,
Line 1, please delete "ship," and insert therefor -- ships, --; and Column 3,
Line 40, after "cable 2," please insert -- a --.

Signed and Sealed this

Eighth Day of April, 2003

JAMES E. ROGAN
*Director of the United States Patent and Trademark Office*